US009171486B1

(12) United States Patent
Anderton et al.

(10) Patent No.: US 9,171,486 B1
(45) Date of Patent: Oct. 27, 2015

(54) ZIPP SEAL SECURITY SYSTEMS

(76) Inventors: Stoney Anderton, Roosevelt, UT (US); Larry Anderton, Roosevelt, UT (US)

( * ) Notice: Subject to any disclaimer, the term of this patent is extended or adjusted under 35 U.S.C. 154(b) by 498 days.

(21) Appl. No.: 13/550,418

(22) Filed: Jul. 16, 2012

Related U.S. Application Data

(60) Provisional application No. 61/514,426, filed on Aug. 2, 2011.

(51) Int. Cl.
*B65D 27/30* (2006.01)
*G09F 3/03* (2006.01)

(52) U.S. Cl.
CPC ..... *G09F 3/037* (2013.01)

(58) Field of Classification Search
USPC ..... 292/307 A, 307 B, 325, 321, 319
See application file for complete search history.

(56) References Cited

U.S. PATENT DOCUMENTS

| | | | | |
|---|---|---|---|---|
| 3,467,427 | A | 9/1969 | Moberg et al. | |
| 3,717,369 | A | 2/1973 | Stoffel et al. | |
| 4,899,781 | A | 2/1990 | Monroe | |
| 7,259,674 | B2 * | 8/2007 | Marsilio et al. | 340/572.1 |
| 7,650,768 | B2 * | 1/2010 | Fawcett et al. | 70/58 |
| 2007/0289637 | A1 | 12/2007 | Gordon | |
| 2008/0041122 | A1 | 2/2008 | Gordon | |
| 2010/0117017 | A1 | 5/2010 | Freyre | |

* cited by examiner

*Primary Examiner* — Mark Williams
(74) *Attorney, Agent, or Firm* — RG Patent Consulting, LLC; Rachel Gilboy

(57) ABSTRACT

A Zipp Seal apparatus which is designed to detect unlawful access of oil, and also to help ensure that oil tanks are and remain properly sealed. The invention may be an injection-molded plastic or nylon unit containing a zip tie with a solid cylinder component and a tail with one-way feeding teeth. The cylinder can be inserted into a hole on an oil tank valve, and the zip tie end can be inserted into the cylinder end of the unit. This may secure the valve into a specific position. If the invention is found in a different position, employees will know that the oil has been tampered with or unlawfully accessed.

17 Claims, 5 Drawing Sheets

ZIPP SEAL SECURITY SYSTEMS

CROSS-REFERENCE TO RELATED APPLICATION

The present application is related to and claims priority from prior provisional application Ser. No. 61/514,426, filed Aug. 2, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of securing means and more specifically relates to zipp seal security systems.

2. Description of the Related Art

Oil and other petroleum products may used to provide fuels to power consumer devices such as automobiles and to provide energy for heating buildings. Petroleum is a naturally occurring, flammable liquid consisting of a complex mixture of hydrocarbons of various molecular weights and other liquid organic compounds, which are found in geologic formations beneath the Earth's surface. Petroleum is recovered mostly through drilling and pumping processes. The petroleum industry is involved in exploration, extraction, refining, transporting, and marketing petroleum products which are expensive and may be dangerous. The largest volume products of the industry are fuel oil and petrol. Petroleum is also the raw material for many chemical products, including pharmaceuticals, solvents, fertilizers, pesticides, and plastics.

Petroleum is pumped to the surface where it is processed. The petroleum is piped to storage facilities. This piping comprises pipes and joints including valves for controlling the flow or restriction of flow. It is crucial to prevent tampering or unauthorized access to the petroleum in the interest of safety, of the environment and to prevent financial losses. If oil is tampered with or unlawfully accessed, the petroleum (oil and gas) companies who own the petroleum will be in violation of federal regulation and may be penalized. Also, a petroleum tank valve that is tampered with may allow oil or gas to be easily stolen or removed from its storage tank, which can result in the loss of considerable amounts of money and royalties. It is desirable that petroleum be properly monitored from loss.

Various attempts have been made to solve the above-mentioned problems such as those found in U.S. Pat. and Pub. Nos. U.S. Pat. Nos. 3,467,427; 3,717,369; 4,899,781; 2008/0041122; 2010/0117017, and 2007/0289637. This prior art is representative of securers. None of the above inventions and patents, taken either singly or in combination, is seen to describe the invention as claimed.

Ideally, a zipp seal security system should be user-friendly, safe to use and secure and, yet would operate reliably and be manufactured at a modest expense. Thus, a need exists for a reliable zipp seal security system to avoid the above-mentioned problems.

BRIEF SUMMARY OF THE INVENTION

In view of the foregoing disadvantages inherent in the known securing art, the present invention provides a novel zipp seal security system. The general purpose of the present invention, which will be described subsequently in greater detail is to provide safe and effective means to secure valves into specific positions.

Zipp Seal is designed to provide a means of documenting the removal of oil or liquid hydrocarbons from storage tanks for royalty purposes. This innovative product features a zip seal used to secure valves into specific positions. If oil and gas company employees find the valve in a different position, they will know that the oil has been unlawfully accessed. To move the valve the present invention needs to be tampered with or destroyed, leaving a tell-tale visual clue to the oilfield employee. Additionally, using this product may also substantially ensure that the tanks are properly sealed, so as to prevent spillage or leaks. Oil and gas companies may benefit from the security and reassurance afforded by this product.

A zipp seal security system is disclosed herein, in a preferred embodiment, comprising: a zipp seal (acting as a seal and dart system) having a proximate end having a tail, the tail comprising a first end and a second end; a guide notch on the first end followed by a gear rack having (one way) locking teeth and a stop block, in series respectively, continuing towards the second end as a flexible member acting in a capacity of a seal terminating at a hinge. The distal end has a head, the head comprising: a cylinder with a ratchet head. The tail and head are connected via a body. In preferred embodiments the zipp seal comprises an injection-molded plastic, since it is cost-effective to manufacture in quantity; however it may comprise other suitably equivalent materials in alternate embodiments. The device comprises a single-use apparatus and may not be reused.

The body comprises a surface suitable for displaying indicia thereon; wherein the indicia comprises a serial number (that may or may not be inscribed on a plate that can be affixed thereto.) Indicia may also comprise a company name and/or logo or the like. This serves as an identification means whereby an existing zipp seal cannot be simply cut off and readily replaced by a non-authentic clone/reproduction. The body is preferably stepped; the steps comprise at least 4 different circumference sizes in preferred embodiments (more or less in alternate embodiments). The steps prevent the device from 'falling down' allowing it to sit properly and maintains the device in a preferred orientation relative the oil tank valve.

The tail hingedly rotates in relation to the body to couple to the head via the hinge; wherein the hinge preferably comprises a notch located between the body and the second end of the tail. The hinge (area) comprises a smaller diameter than it's adjacent components such that is flexibly-bendable. The tail also may comprise an aperture located proximate the first end of the tail; the aperture useful for hanging the device for example on a wire for easy retrieval. The tail enters through the ratchet head (when inserted by employee), the guide notch initiating entry through the ratchet when the tail (teeth on gear rack are first inserted), the gear rack moving in relation to the ratchet (as pushed through, the teeth only allowing insertion into the rachet head, not retraction from) to a stopping point determined by the stop block thereby defining a closed and locked relationship when reached. The stop block is at that point contact-adjacent the cylinder of the head. The flexible member comprises a non-arcuate profile in a non-in-use condition and an arcuate profile in relation to the body during in-use periods.

The cylinder of the distal end can be inserted into a hole on an oil tank valve, and the gear rack can be inserted through the ratchet head (as previously mentioned) using the locking teeth to lock the tail to the cylinder to control relative motion of the oil tank valve. The body when installed in the hole on the oil tank valve is normally oriented perpendicularly to a ground surface; and the zipp seal, if found in a different position than originally placed, serves to visually warn at least one employee that the oil tank valve has been tampered with (unauthorized access has taken place.)

A method of use for the zipp seal security system is also described herein preferably comprising the steps of inserting a zipp seal into a hole on an oil tank valve; and locking the zipp seal in a specific-position such that if found in a different-position than originally placed, serves to visually warn at least one employee that the oil tank valve has been tampered with. The method may further comprise the step of visually monitoring the specific-position of the zipp seal over a time duration. Further the method may comprise the step of unlocking and removing the zipp seal when desired such that the oil tank valve can be manipulated by an authorized employee.

The present invention holds significant improvements and serves as a zipp seal security system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, zipp seal security systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a securing device and more particularly to a zipp seal security system as used to improve the security of oilfield valves and to deter tampering and theft of oil products.

Generally speaking, Zipp Seal is designed to detect unlawful access of oil, and also to ensure that oil tanks are properly sealed. The invention may comprise an injection-molded plastic or nylon unit containing a zip tie hook at one end and a solid cylinder component on the other. The cylinder (may be round or other shape as appropriate) can be inserted into a hole on an oil tank valve, and the zip tie end can be inserted into the cylinder end of the unit. This may secure the valve into a specific position. If the invention is found in a different position, employees will know that the oil has been tampered with or unlawfully accessed.

Figure 1:
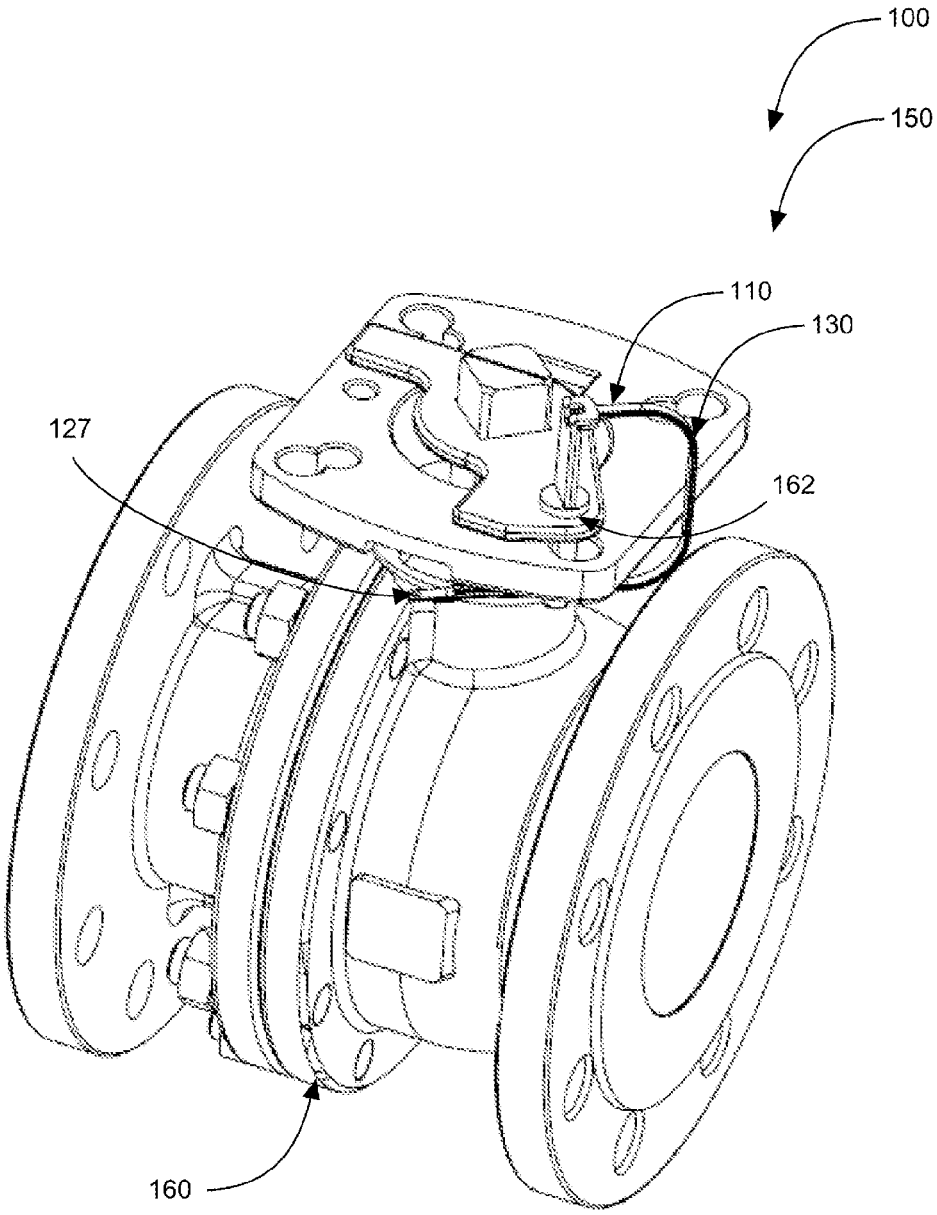
FIG. 1 shows a perspective view illustrating a valve with a zipp seal of a zipp seal security system in an in-use condition according to an embodiment of the present invention.
Figure 2:
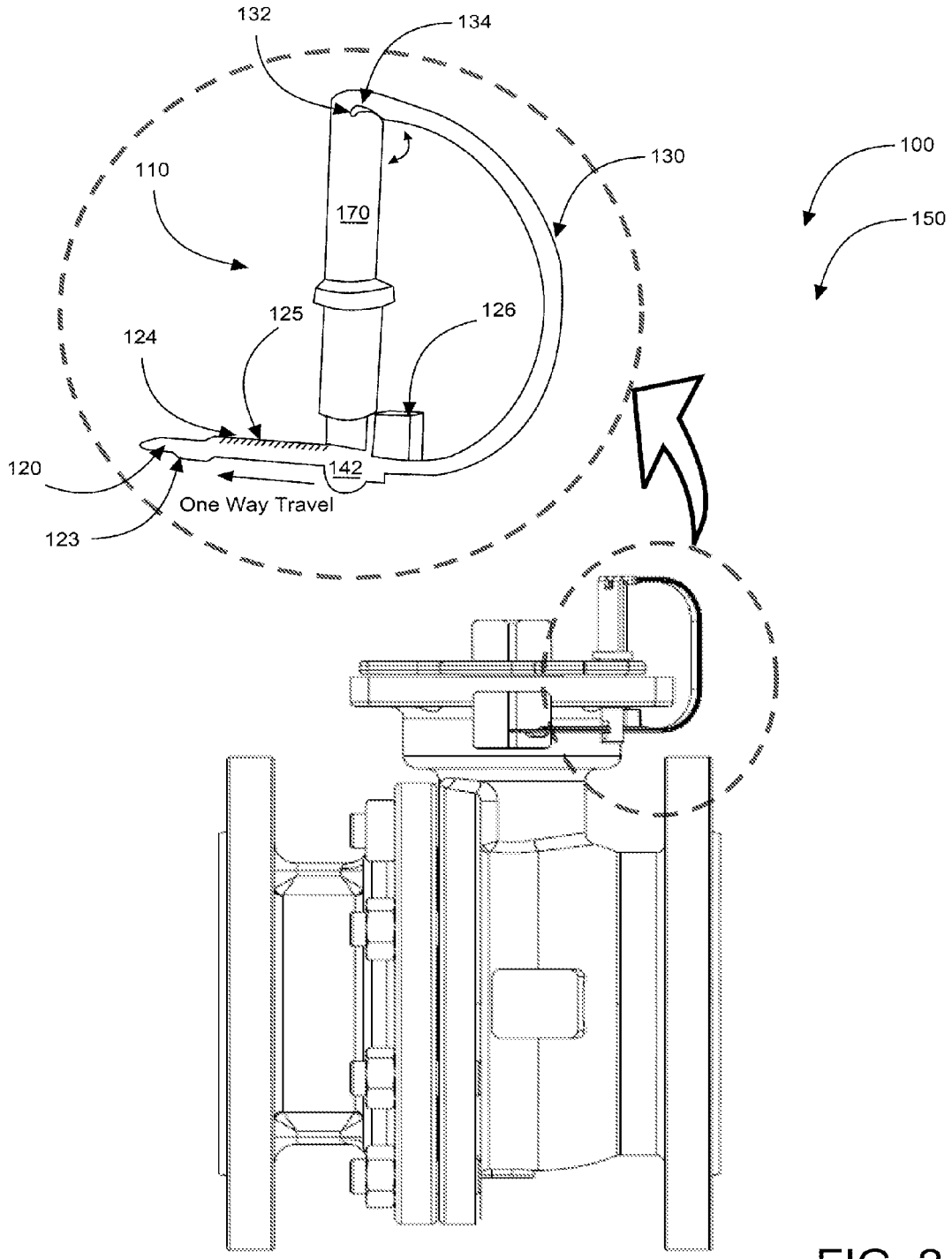
FIG. 2 is a side view illustrating the valve with the zipp seal of the zipp seal security system in an in-use condition according to an embodiment of the present invention of FIG. 1.
Figure 3A:
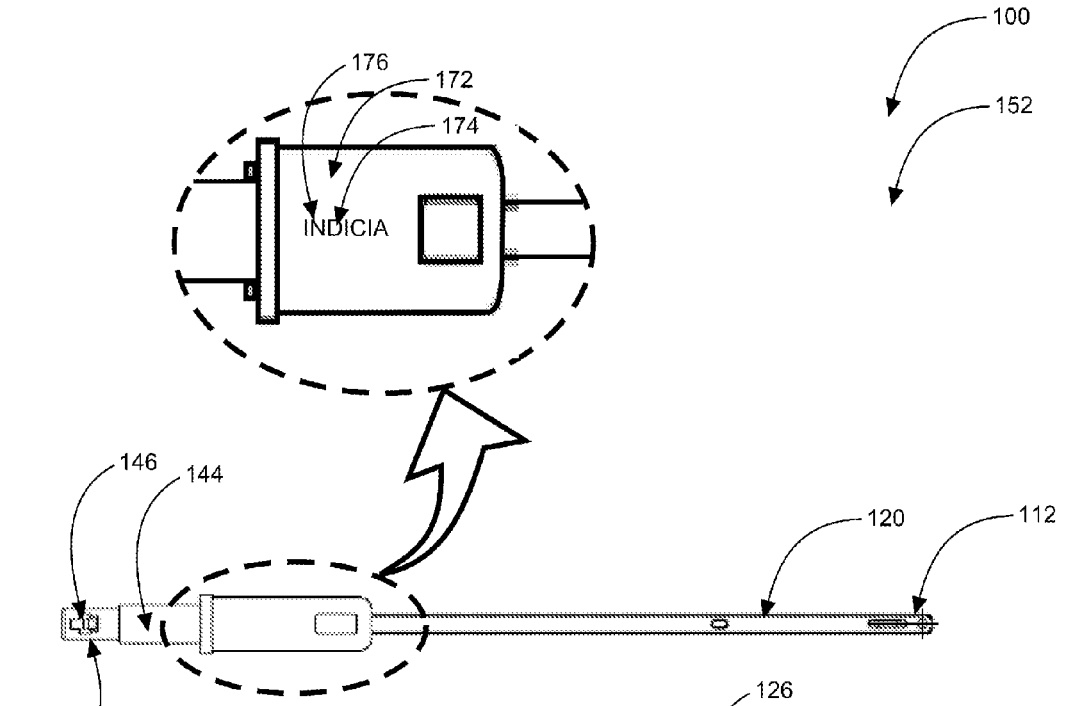
FIG. 3A is a top view illustrating the zipp seal according to an embodiment of the present invention of FIG. 1.
Figure 3B:
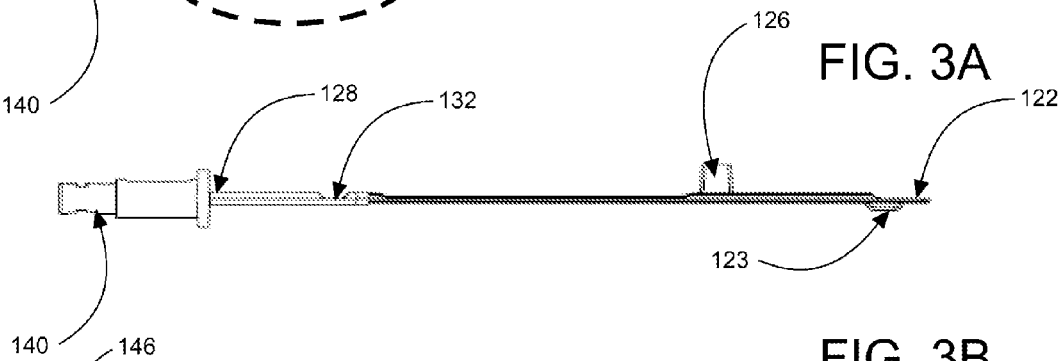
FIG. 3B is a side view illustrating the zipp seal according to an embodiment of the present invention of FIG. 1.
Figure 3C:
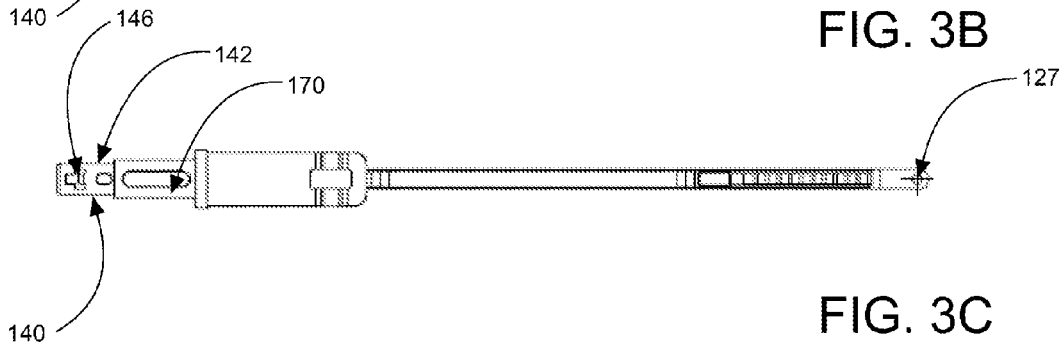
FIG. 3C is a bottom view illustrating the zipp seal according to an embodiment of the present invention of FIG. 1.
Figure 4:
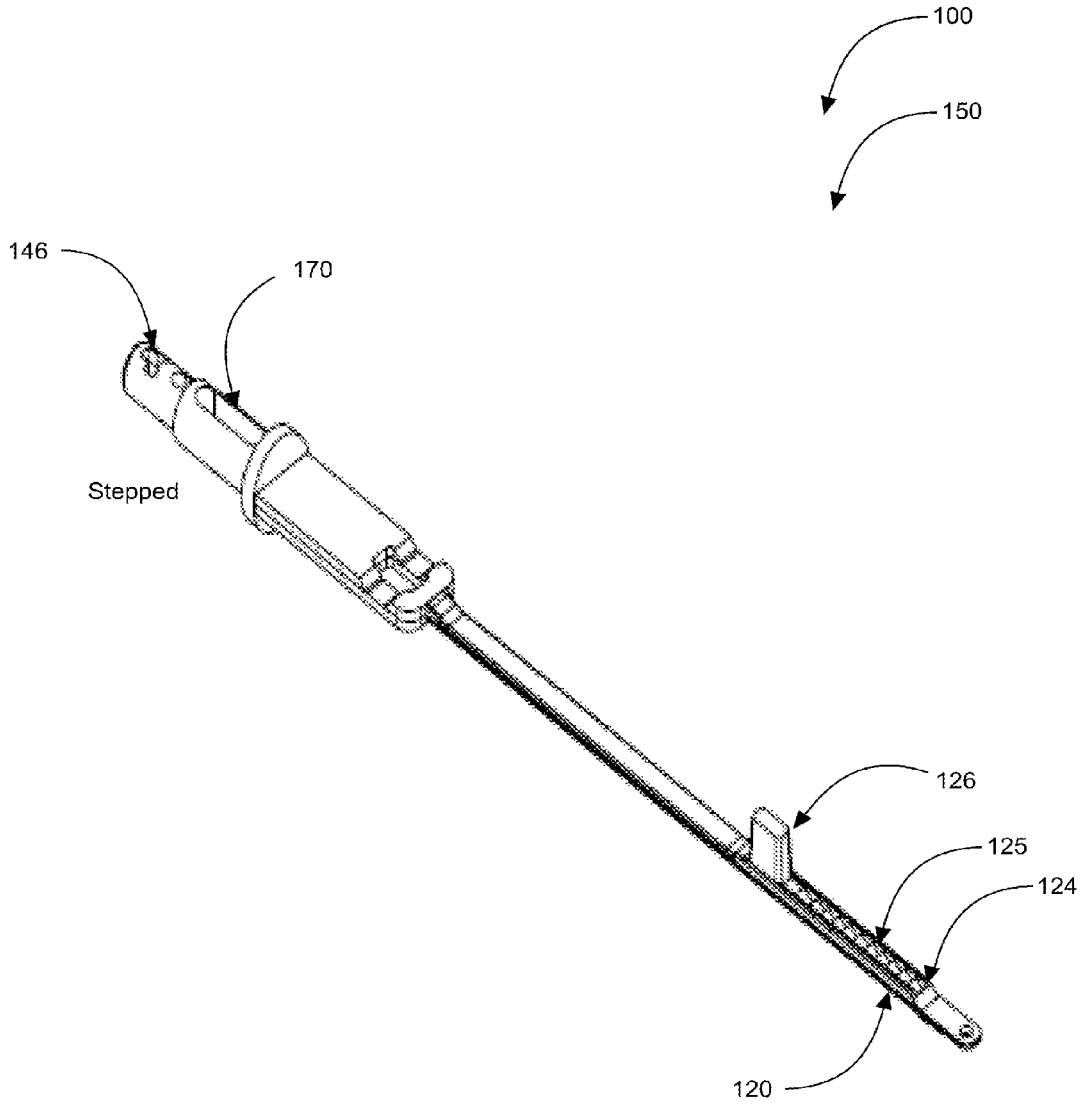
FIG. 4 is a perspective view illustrating the zipp seal according to an embodiment of the present invention of FIG. 1.

Referring to the drawings by numerals of reference there is shown in FIGS. 1 and 2, perspective views illustrating oil tank valve 160 with zipp seal 110 of zipp seal security system 100 in an in-use condition 150 according to an embodiment of the present invention.

Zipp seal security system 100 preferably comprises: zipp seal 110 having a proximate end 112 having tail 120; tail 120 comprising first end 122 and second end 128; guide notch 123 on first end 122 followed by gear rack 124 (having locking teeth 125) and stop block 126, in series respectively, continuing towards second end 128 as a flexible member 130 acting in a capacity of a seal terminating at a hinge 134. Zipp seal 110 further comprises distal end 140 having head 142. Head 142 comprises cylinder 144 with ratchet head 146. Zipp seal 110 further comprises body 170; wherein body 170 comprises a surface 172 suitable for displaying indicia 174 thereon. Tail 120 hingedly rotates in relation to body 170 to couple to head 142 via hinge 134. In this way the present invention can be coupled and locked to itself to provide a security means. The present device is safe in that it may be severed in the case of an emergency and doesn't create any hazardous conditions, even being around potentially explosive gases and substances.

Tail 120 (as manipulatedly fed by user) enters through ratchet head 146, guide notch 123 initiating entry through head 142. Gear rack 124 moves in relation to ratchet head 146 to a stopping point determined by stop block 126 thereby defining a closed and locked relationship when reached, wherein stop block 126 is contact-adjacent cylinder 144 of head 142. This relationship ensures that the present invention is suitably durable in-use. Cylinder 144 of distal end 140 can be inserted into hole 162 on oil tank valve 160, and gear rack 124 can be inserted through ratchet head 146 using locking teeth 125 to lock tail 120 to cylinder 144 to control motion of oil tank valve 160. Zipp seal 110, if found in a different position than originally placed, serves to visually warn at least one employee that oil tank valve 160 has been tampered with. In this way zipp seal 110 allows at least one employee to visually inspect as to if tanks are properly sealed, as also described in method of use 500, shown in FIG. 5.

Flexible member 130 comprises an arcuate shape in an in-use condition 150, as shown in FIGS. 1 and 2. Body 170 when installed in hole 162 on oil tank valve 160 is normally oriented perpendicular to a ground surface. The device can also be used on different orientations in other applications. It should also be noted that the present invention may find useful application outside the oilfield industry; however the oilfield application has been used and described in detail to enable the device for the reader and is in no way to be taken as limiting it's scope, but rather as an exemplary means. Hinge 134 comprises notch 132 in preferred embodiments, preferably located between body 170 and second end 128 of tail 120. Other hinging and bending means may be employed.

Zipp seal security system 100 may further comprise a sensor (not shown) to communication electronically in certain embodiments. Locking teeth 125 of gear rack 124 are one-way teeth such that locking teeth 125 once entering ratchet head 146 prevent rearward movement of gear rack 124 in relation to ratchet head 146 and once locked zipp seal 110 must be severed to be removed from oil tank valve 160.

Referring now to FIGS. 3A-3C and 4 showing a top view, a side view, a bottom view, and a perspective view respectively illustrating zipp seal 110 according to an embodiment of the present invention of FIG. 1.

Flexible member 130 comprises a non-arcuate profile in a non-in-use condition 152. Zipp seal 110 preferably comprises an injection-molded plastic and/or nylon and/or polypropylene. Upon reading this specification, it should be appreciated that, under appropriate circumstances, considering such issues as user preferences, design preference, structural requirements, marketing preferences, cost, available materials, technological advances, etc., other materials such as, for example, plastics, non-plastics, rubbers, ferrous, non-ferrous materials, composites, etc., may be sufficient.

Zipp seal security system 100 preferably comprises indicia 174 including a serial number 176 which may be inscribed on a plate or alternately serial number 176 may be inscribed into body 170. Indicia 174 may also comprise a company name, logo, date stamp or indicia 174 deemed appropriate to the application the present invention is used in.

As shown body 170 is preferably stepped. Body 170 'as stepped' preferably comprises at least 4 different circumference sizes. Aperture 127 is located proximate first end 122 of tail 120, as previously mentioned to hang the device from for convenience of storage.

Figure 5:
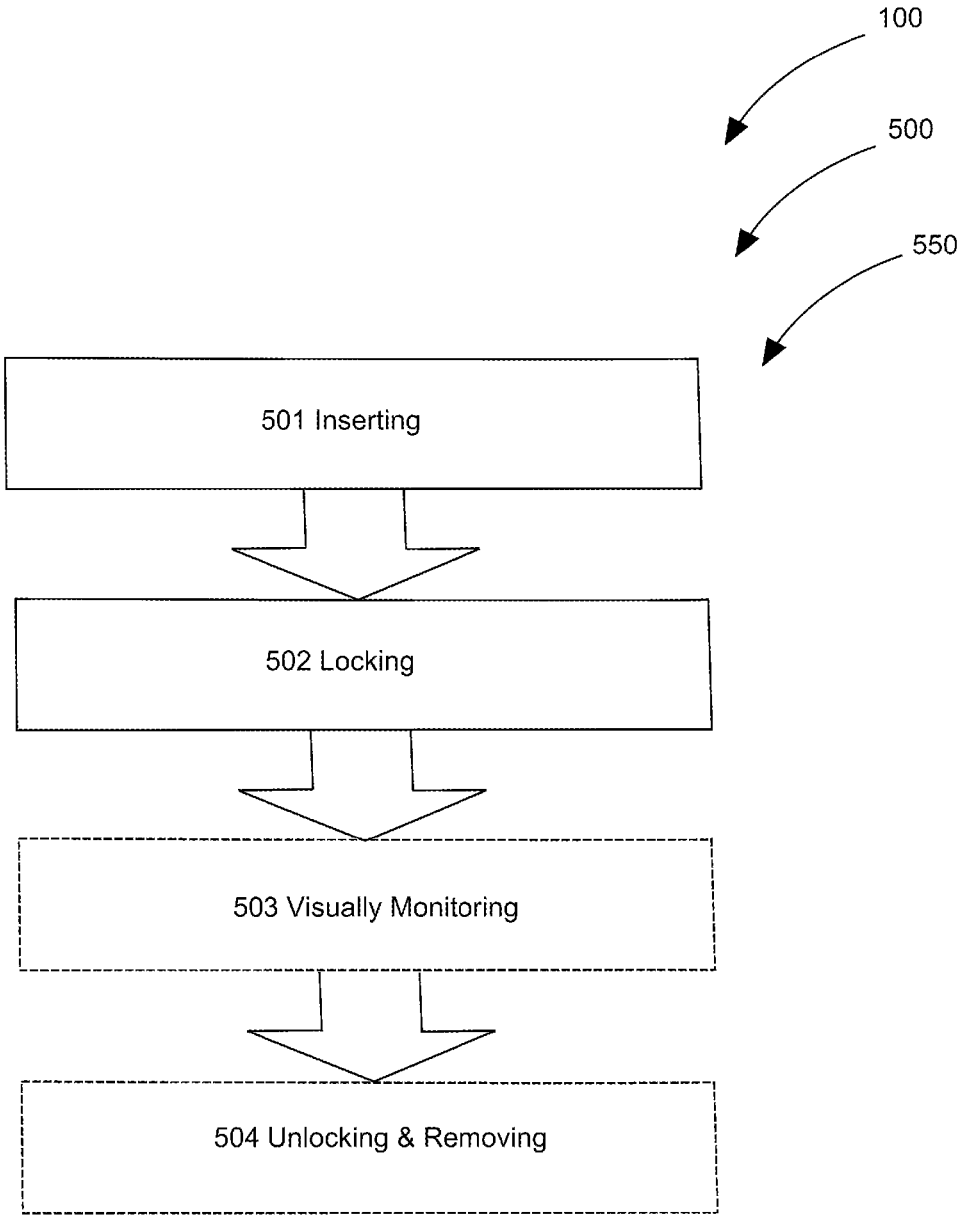
FIG. 5 is a flowchart illustrating a method of use for the zipp seal security system according to an embodiment of the present invention of FIGS. 1-4.

Referring now to FIG. 5, a flowchart 550 illustrating a method of use 500 for zipp seal security system 100 according to an embodiment of the present invention of FIGS. 1-4.

Method of use 500 for a zipp seal security system 100 comprises the steps of: step one 501 inserting zipp seal 110 into hole 162 on oil tank valve 160; and step two 502 locking zipp seal 110 in a specific-position such that if found in a different-position than originally placed, the device serves to visually warn at least one employee that oil tank valve 160 has been tampered with. Method of use 500 may also comprise step three 503 visually monitoring the specific-position of zipp seal 110 over a time duration; and step four 504 unlocking and removing zipp seal 110 when desired such that oil tank valve 160 can be manipulated by an authorized at least one employee. Control of oil tank valve 160 helps to ensure tanks are properly sealed.

It should be noted that step 503 and 504 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, §6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A zipp seal security system comprising:

a) a zipp seal having;

ii) a proximate end comprising:

(1) a tail:

(2) a flexible seal;

(3) a hinge;

(4) a guide notch;

(5) a gear rack;

(6) locking teeth;

(7) a stop block;

v) a distal end comprising:

(1) having a head, said head comprising;

(2) a cylinder with a ratchet head;

vi) a body; and b) an oil tank valve comprising at least two oil tank valve alignment holes;

c) wherein said tail is structured and arranged as a flexible seal, and further adapted to terminate at a hinge;

d) wherein said tail comprises a first end and a second end;

e) wherein said first end is structured and arranged with a guide notch and comprises an adjacent gear rack;

f) wherein said gear rack comprises locking teeth and a stop block;

g) wherein said gear rack is arranged adjacent to said guide notch and on said second-end side of said guide notch;

h) wherein said body is structured and arranged to fit through said at least two oil tank valve alignment holes of said oil tank valve;

i) wherein said body comprises a surface suitable for displaying indicia thereon;

j) wherein said indicia comprises a serial number;

k) wherein said serial number is structured and arranged as an identification means whereby an existing zipp seal to which it is attached cannot be cut off from said oil tank valve and replaced by a non-authentic clone/reproduction of said zipp seal without detection;

l) wherein said tail is structured and arranged to hingedly rotates in relation to said body and adapted to couple to said head via said hinge;

m) wherein said tail is structured and arranged to enters through said ratchet head, said guide notch is structured and arranged as a guide for entry of said tail through said ratchet head, said gear rack is structured and arranged in conjunction with said stop block such that said tail only advances to a stopping point pre-determined by said stop block thereby defining a closed and locked relationship when reached, wherein said stop block is contact-adjacent said cylinder of said head;

n) wherein said cylinder of said distal end can be inserted into a hole on an oil tank valve, and said gear rack can be inserted through said ratchet head using said locking teeth to lock said tail to said cylinder to control motion of said oil tank valve; and o) wherein said zipp seal, if found in a different position than originally placed, serves to visually warn at least one employee that said oil tank valve has been tampered with.

2. The zipp seal security system of claim 1 wherein use of said zipp seal allows said at least one employee to visually inspect as to if tanks are properly sealed.

3. The zipp seal security system of claim 2 wherein said zipp seal comprises an injection-molded plastic.

4. The zipp seal security system of claim 2 wherein said zipp seal comprises nylon.

5. The zipp seal security system of claim 2 wherein said indicia comprises a serial number.

6. The zipp seal security system of claim 2 wherein said serial number is inscribed on a plate.

7. The zipp seal security system of claim 2 wherein said indicia comprises a company name.

8. The zipp seal security system of claim 1 wherein said locking teeth of said gear rack are one-way teeth such that locking teeth once entering said ratchet head prevent rearward movement of said gear rack in relation to said ratchet head and once locked said zipp seal must be severed to be removed from said oil tank valve.

9. The zipp seal security system of claim 1 wherein said body is stepped.

10. The zipp seal security system of claim 1 wherein said flexible member comprises an arcuate shape in an in-use condition.

11. The zipp seal security system of claim 1 wherein said flexible member comprises a nonarcuate profile in a non-in-use condition.

12. The zipp seal security system of claim 1 wherein said body when installed in said hole on said oil tank valve is oriented perpendicular to a ground surface.

13. The zipp seal security system of claim 1 wherein said tail comprises an aperture located proximate said first end of said tail.

14. The zipp seal security system of claim 1 wherein said hinge comprises a notch located between said body and said second end of said tail.

15. The zipp seal security system of claim 9 wherein said body as stepped comprises at least 4 four different circumference sizes.

16. The zipp seal security system of claim 1 further comprising a sensor.

17. A zipp seal security system comprising:

a) a zipp seal having;

iv) a proximate end comprising:

(1) a tail:

(2) a flexible seal;

(3) a hinge;

(4) a guide notch;

(5) a gear rack;

(6) locking teeth;

(7) a stop block;

v) a distal end comprising:

(1) having a head, said head comprising;

(2) a cylinder with a ratchet head;

vi) a body; and b) an oil tank valve comprising at least two oil tank valve alignment holes;

c) wherein said tail is structured and arranged as a flexible seal, and further adapted to terminate at a hinge;

d) wherein said tail comprises a first end and a second end;

e) wherein said first end is structured and arranged with a guide notch and comprises an adjacent gear rack;

f) wherein said gear rack comprises locking teeth and a stop block;

g) wherein said gear rack is arranged adjacent to said guide notch and on said second-end side of said guide notch;

h) wherein said body is structured and arranged to fit through said at least two oil tank valve alignment holes of said oil tank valve;

i) wherein said body comprises a surface suitable for displaying indicia thereon;

j) wherein said indicia comprises a serial number;

k) wherein said serial number is structured and arranged as an identification means whereby an existing zipp seal to which it is attached cannot be cut off from said oil tank valve and readily replaced by a non-authentic clone/reproduction of said zipp seal without detection;

l) wherein said tail is structured and arranged to hingedly rotates in relation to said body and adapted to couple to said head via said hinge;

m) wherein said tail is structured and arranged to enter through said ratchet head, said guide notch is structured and arranged as a guide for entry of said tail through said ratchet head, said gear rack is structured and arranged in conjunction with said stop block such that said tail only advances to a stopping point pre-determined by said stop block thereby defining a closed and locked relationship when reached, wherein said stop block is contact-adjacent said cylinder of said head;

n) wherein said zipp seal comprises an injection-molded plastic;

o) wherein said body comprises a surface suitable for displaying indicia thereon;

q) wherein said serial number is inscribed on a plate;

r) wherein said body is stepped;

s) wherein said body as stepped comprises at least 4 different circumference sizes;

x) wherein said flexible member comprises a non-arcuate profile in a non-in-use condition;

y) wherein said cylinder of said distal end can be inserted into a hole on an oil tank valve, and said gear rack can be inserted through said ratchet head using said locking teeth to lock said tail to said cylinder to control motion of said oil tank valve;

z) wherein said body when installed in said hole on said oil tank valve is oriented perpendicular to a ground surface; and aa) wherein said zipp seal, if found in a different position than originally placed, serves to visually warn at least one employee that said oil tank valve has been tampered with.

* * * * *